United States Patent [19]

Dennis, Jr. et al.

[11] 4,371,375

[45] Feb. 1, 1983

[54] APPARATUS AND PROCESS FOR DRYING SAWDUST

[76] Inventors: Silas P. Dennis, Jr.; Tony M. Dennis, both of P.O. Box 279, Albemarle, N.C. 28001

[21] Appl. No.: 322,179

[22] Filed: Nov. 17, 1981

[51] Int. Cl.[3] ..... C10L 9/08; F26B 5/04

[52] U.S. Cl. ..... 44/2; 44/1 E; 34/16.5; 34/57 D; 34/173

[58] Field of Search ..... 44/2, 1 E, 10 J, 10 E, 44/12; 34/16.5, 57 D, 164, 168, 171, 173, 178

[56] References Cited

U.S. PATENT DOCUMENTS

| | | | |
|---|---|---|---|
| 2,022,761 | 12/1935 | Fenby | 34/57 D |
| 2,118,208 | 5/1938 | Lewers | 34/173 X |
| 2,222,673 | 11/1940 | Lewers | 110/225 |
| 2,283,641 | 5/1942 | Martin et al. | 34/173 X |
| 2,561,925 | 7/1951 | Jakubik | 34/164 |
| 3,075,298 | 1/1963 | Schaub | 34/57 D |
| 3,733,714 | 5/1973 | Connor | 34/173 |
| 3,752,656 | 8/1973 | Rutkowski et al. | 44/2 |

*Primary Examiner*—Carl F. Dees
*Attorney, Agent, or Firm*—Bell, Seltzer, Park & Gibson

[57] ABSTRACT

A sawdust drying apparatus and process wherein sawdust passes downwardly in a sinuous fashion to and through multiple, vertically spaced dryer plates at a temperature and velocity so as to progressively dry the sawdust and render it suitable as a highly combustible wood fiber fuel.

16 Claims, 6 Drawing Figures

APPARATUS AND PROCESS FOR DRYING SAWDUST

BACKGROUND OF THE INVENTION

1. Field of the Invention

The present invention relates to an apparatus and a process for reducing the moisture content of sawdust. It particularly relates to a dryer apparatus and associated process wherein sawdust passes downwardly in a sinuous fashion to and through multiple, vertically-spaced dryer plates at a temperature and velocity so as to progressively dry the sawdust.

2. Description of the Prior Art

It has been shown that dried sawdust is an excellent, low-cost fuel for use in certain manufacturing operations, for example, in the heating of brick kilns. However, because undried or "green" sawdust has a moisture content on the order of 30–50%, it is not suitable for use as a fuel until the moisture content has been lowered substantially, for example, to about 12% by weight, or less.

Many apparatus and processes have been proposed and investigated over a period of years for reducing the moisture content of various materials. U.S. Pat. Nos. 2,104,526, 2,118,208 and 2,222,673 are representative of patents describing multiple hearth drying and incinerating apparatus for treating sewage sludge. These apparatus include a plurality of vertically-spaced hearths on which the material is "rabbled", with the material passing progressively downwardly to underlying hearths through alternating peripheral and central openings. The material 13 is ultimately burned within the apparatus.

Despite the high level of activity in the development of apparatus and processes for drying moisture laden material, and in many instances thereafter incinerating in the same operation, the need still exists for an effective, commercially feasible apparatus and process for reducing the moisture content of sawdust, rendering it suitable for use as a highly combustible fuel.

SUMMARY OF THE INVENTION

The present invention provides a novel and versatile dryer apparatus and associated method commercially suitable for treating green sawdust to reduce its moisture content to a point where the sawdust may be used as a fuel.

In accordance with the present invention, there is provided a dryer apparatus comprising an upright housing having a plurality of vertically spaced, horizontal, metal dryer plates therein. Each plate has spaced-apart openings through which sawdust introduced at the top of the housing may successively pass downwardly to and through the plates in a sinuous fashion. An upright rim is formed at the periphery of each of the dryer plates for preventing the sawdust from moving outwardly off of the plates. A sawdust agitator is associated with each plate and comprises rotating arms extending outwardly in overlying relation to the plate, teeth extending from the arms and terminating in close relationship to the underlying plate for agitating the sawdust and plow means carried by the outer end portion of at least certain arms for engagingly deflecting the sawdust resting on the respective, underlying plate toward the axis of the arms. The plow means comprises an elongate member having an outward leading end positioned inwardly of and closely adjacent the upright rim and an inward trailing end. The elongate member is angularly disposed with respect to its associated arm at an angle effective to deflect the sawdust inwardly. The dryer further includes means for permitting the introduction of hot, dry air into the dryer adjacent the lowermost dryer plate and a well provided below the lowermost plate for receiving the dried sawdust.

In accordance with another aspect of the invention, there is provided a sawdust drying system comprising a dryer having an upright housing and a plurality of vertically spaced dryer plates substantially as described above, a first storage means for dried sawdust, a grinding means and a second storage means for ground, dried sawdust, all of the components being arranged in series and connected by conveyors.

In accordance with yet another aspect of the present invention, there is provided a process for reducing the moisture content of sawdust, comprising the steps of: (1) conveying the sawdust to the uppermost of a plurality of vertically spaced drying zones; (2) introducing hot, dry air adjacent the lowermost zone and allowing the air to flow upwardly through the zones; (3) successively passing the sawdust downwardly from each zone to the underlying zone by discharging the sawdust from each zone through spaced-apart discharge openings, the discharge openings of each zone being out of vertical alignment with the discharge openings of the underlying zone for allowing the sawdust to be supported at each zone for a residence time that will permit the sawdust to progressively dry as it passes down through the respective zones; (4) agitating the sawdust with a circular raking action while it is supported at each zone in order to facilitate the drying of the sawdust and the discharge of the sawdust from the zone, and simultaneously deflecting the sawdust at the periphery of the zone inwardly toward the center of the zone in order to further enhance the drying and to overcome the outward migration imparted to the sawdust by said circular raking action; and (5) recovering the dried sawdust below the lowermost zone.

BRIEF DESCRIPTION OF THE DRAWINGS

The invention will be more fully understood from the following detailed description thereof taken in connection with the accompanying drawings, which form a part of this application and in which.

DETAILED DESCRIPTION

While the present invention will be described hereinafter with particular reference to the accompanying drawings, it is to be understood at the outset of the description which follows that it is contemplated that the present invention may be varied in specific detail while still achieving the desirable characteristics and features of the present invention. Accordingly, the description is to be understood as a broad enabling teaching directed to persons skilled in the applicable arts, and is not to be understood as restrictive.

Figure 1:
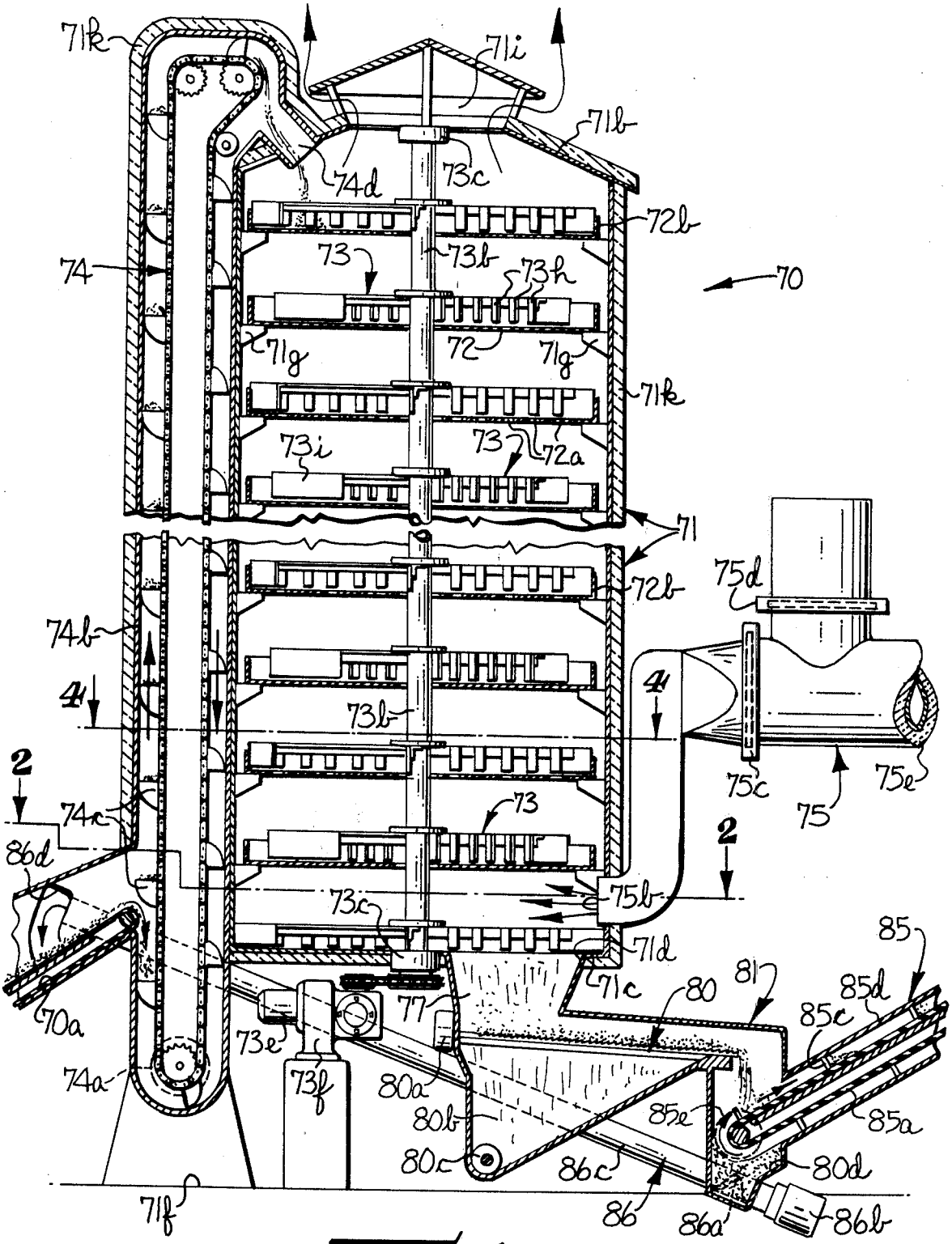
FIG. 1 is a vertical section view through the sawdust dryer of the invention showing the hot air inlet for the lower portion of the dryer approximately 90° out of position for the purpose of clarity and illustration.

Referring to the drawings and particularly to FIG. 1, there is shown a dryer 70 constructed in accordance with the present invention. Dryer 70, which also may be termed as a dryer apparatus, comprises an upright housing 71 that is preferably substantially circular in plan and includes a substantially circular upright side wall 71*a*, and a substantially horizontally disposed bottom wall 71*c* having a sawdust discharge or egress opening 71*d* therein. The upright housing 71 of dryer 70 is supported on suitable legs (not shown) that may rest on a suitable concrete base.

The upright housing 71 has a plurality of vertically spaced, substantially horizontal metal dryer plates 72 therein, each of which is of a somewhat lesser external diameter than the diameter of the substantially circular side wall 71*a* of the dryer 70 so that a portion of the heated air introduced into housing 71 may flow upwardly from the lower portion of the housing 71 between the edges of the plates 72 and the circular wall 71*a*. Preferably, the side wall 71*a* and the bottom wall 71*c* are also made of metal.

Figure 3:
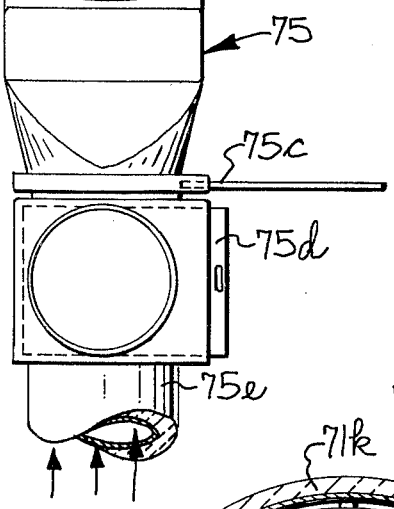
FIG. 3 is a partially exploded perspective view of some of the sawdust agitating elements within the housing of the dryer shown in FIG. 1.
Figure 3:
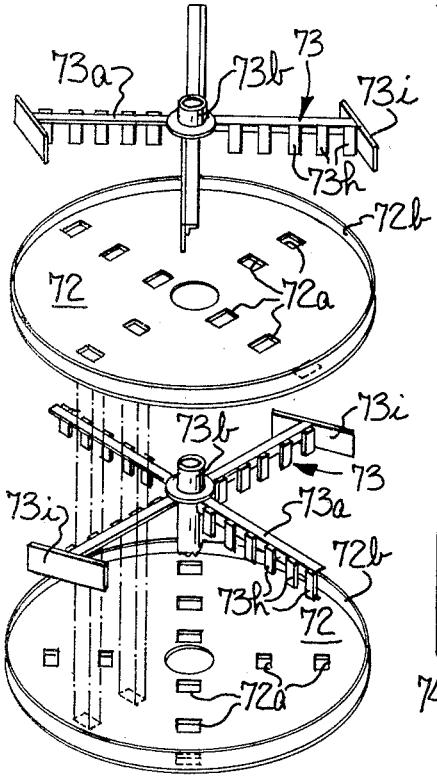
Figure 4:
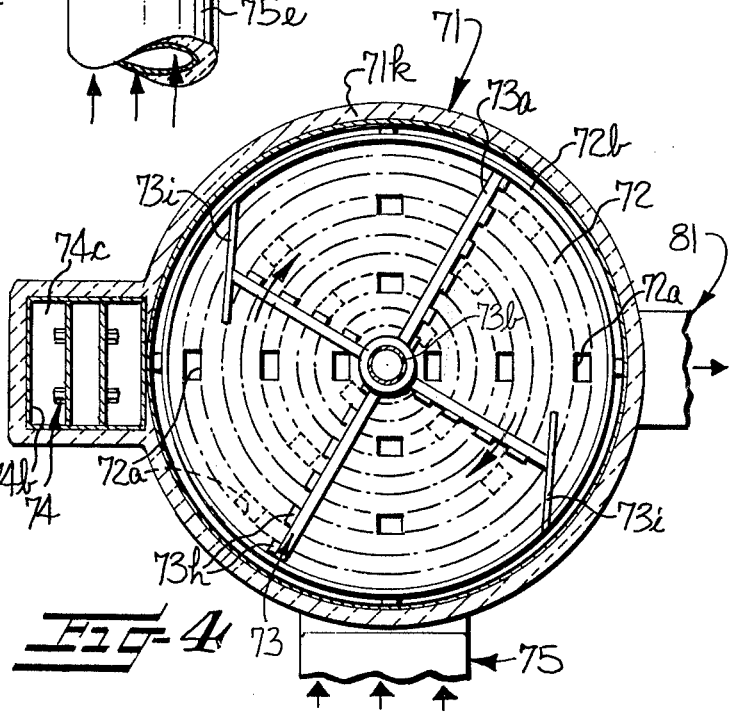
FIG. 4 is a section view of the dryer taken substantially along line 4—4 of FIG. 1.

As best shown in FIGS. 3 and 4, the plates 72 have a plurality of spaced-apart openings 72*a* in each quadrant thereof through which sawdust introduced at the top of the housing 71 may successively pass downwardly to and through the plates 72. Openings 72*a* are located at varying distances from the perimeter of the plates. In the particular embodiment illustrated in the drawings openings 72*a* comprise a series of radially aligned openings in each plate 72 quadrant with primary reference to FIGS. 3 and 4. It will be noted that the openings 72*a* in adjacent plates 72 are staggered relative to each other; i.e., the openings in each plate are out of vertical alignment with the openings in the underlying plate so that the sawdust from one plate 72 may not drop downwardly through an opening 72*a* thereof into an opening of the next lower plate and the sawdust moves downwardly in a sinuous path through the upright housing 71. In the illustrated embodiment, the openings 72*a* in adjacent plates are located forty-five degrees out of alignment.

The plates 72 and the bottom wall 17*c* of the dryer housing 71 are made from metal so that they will absorb heat from the heated air flowing thereby and will thus conduct heat to the sawdust being received thereon and will also radiate heat to the sawdust to enhance the drying of the sawdust as it migrates toward the bottom of the housing 71. The metal side wall 71*a* also absorbs and radiates heat to aid in drying the sawdust.

Each of the metal dryer plates 72 is supported on a plurality of brackets 71*g* carried by and projecting inwardly from the cylindrical or circular side wall 71*a* of the housing 71 and upright rim means 72*b* is connected to peripheral portions of each of the dryer plates 72 and serves to prevent the sawdust from moving outwardly off the plates 72.

Sawdust agitator means 73 are associated with the respective dryer plates 72 and the bottom wall 71*c* of the upright housing 71. Each agitator means 73 comprises a plurality of substantially horizontal rotating arms 73*a* rotatable on a vertical axis and extending outwardly in overlying relation to each of the respective plates 72 and the housing bottom wall 71*c*. In this instance, the outwardly extending arms 73*a* have their inner ends welded or otherwise suitably secured to a vertically disposed, preferably hollow, shaft 73*b* whose upper and lower end portions are suitably journaled, as at 73*c* (FIG. 1), in upper and lower portions of the housing 71. The lower end of the shaft 73*b* is connected to an electric motor 73*e*, via a gear reduction unit 73*f* (FIG. 1), for rotating the agitator arms 73*a* at a relatively slow rate of speed about the substantially vertical axis defined by the shaft 73*b*.

Each of the rotating arms 73*a* has a plurality of longitudinally spaced depending teeth or teeth means 73*h* thereon which extend downwardly from all the arms and terminate in closely spaced relationship to the respective underlying plates to serve for agitating the sawdust for overcoming the outward migration imparted to the sawdust by the raking action of the teeth and enhancement of the drying thereof on the plates 72. As best shown in FIGS. 3 and 4, there are four circularly spaced agitator arms 73*a* above each metal dryer plate 72 and the metal bottom wall 71*c* of housing 71, with the arms 73*a* of each agitator means 73 being spaced substantially equidistantly about the axis of the substantially upright shaft 73*b*. It is preferred that the arms 73*a* of alternate ones of the agitator means 73 be positioned in offset relation with respect to the adjacent arms 73*a* of the intervening sawdust agitator means 73 between the aforementioned alternate agitator means 73. Also, the teeth 73*h* on one arm 73*a* are staggered relative to the teeth 73*h* on the next adjacent arm 73*a* overlying the same dryer plate 72 (or the bottom wall 71*c*) so as to impart increased agitation to the sawdust on the respective plate as the arms rotate thereabove.

Figure 2:
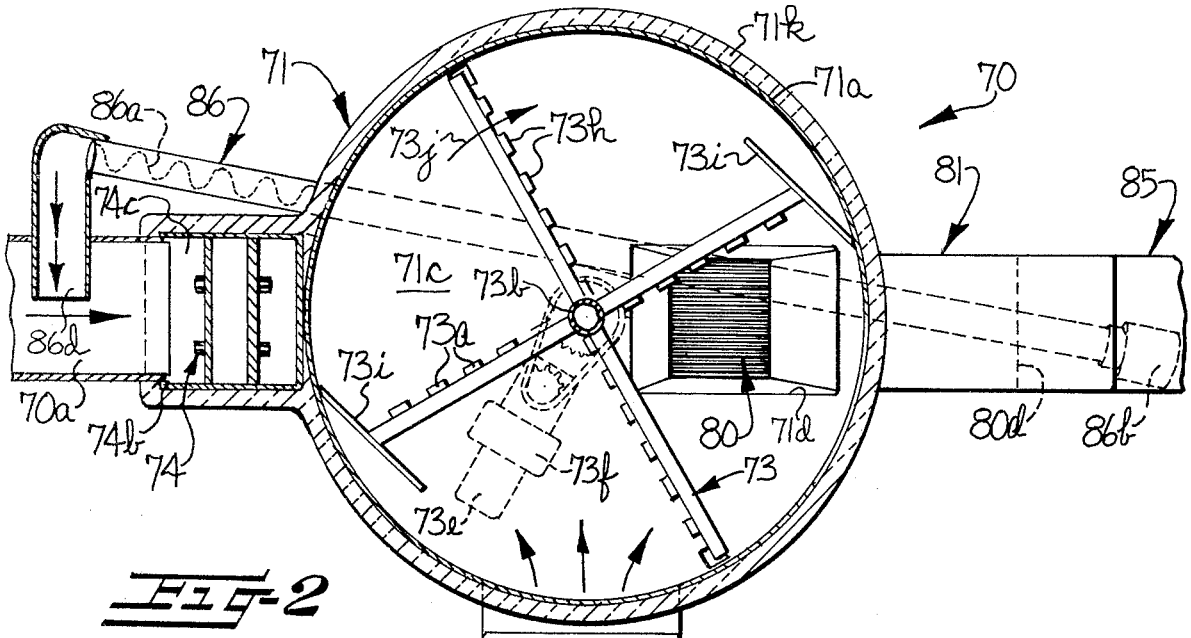
FIG. 2 is a section view of the dryer taken substantially along line 2—2 of FIG . 1.

Plow means are provided for engagingly deflecting the sawdust resting on the metal dryer plates 72 inwardly toward the axis of the arms 73*a* to overcome the outward migration imparted to the sawdust by the teeth and to further enhance the drying of the sawdust. To this end, the outer ends of at least certain of the arms 73*a*, e.g., two diametrically opposite arms 73*a* in this instance, of each sawdust agitator means 73 are provided with respective elongate deflector plates 73*i* welded or otherwise suitably secured thereto. The outward leading ends of the deflector plates 73*i* are positioned inwardly of and closely adjacent the respective upright rim means 72*b* (FIG. 4). In operation, with the arms rotating in the direction of the arrow 73*j* of FIG. 2, the outward ends of the deflector plates lead the trailing inward ends thereof. The deflector plates are angularly disposed with respect to their respective arms so that, during rotation of the agitator arms 73*a*, the deflector plates 73*i* serve to deflect the sawdust resting on the respective underlying plates 72 toward the axis of the arms 73*a* and into the paths of the teeth means 73*h* depending from the respective agitator arms 73*a*.

In order to introduce the sawdust at the top of the housing 71, an upright endless conveyor means 74 (FIG. 1), preferably a bucket conveyor, is mounted exteriorly of, along one side of, and extends substantially the full height of, the dryer housing 71.

The conveyor means 74 may be driven by any suitable means, such as an electric motor 74*a* (FIG. 1), and is housed in an upright enclosure 74*b* carried by the dryer housing 71. It will be observed in the left-hand lower portion of FIG. 1 that the discharge end of the upper flight of the feed conveyor means 70*a* extends into a lower portion of the conveyor enclosure 74b so that the sawdust received on the conveyor 70a is discharged therefrom into the successive buckets 74c of the upright endless conveyor means 74. As each successive bucket 74a reaches the uppermost portion of the bucket conveyor means 74, it is inverted and the contents thereof are emptied through an opening or passageway 74d onto the uppermost metal dryer plate 72 in the dryer housing 71.

To ensure effective drying of the sawdust as it moves downwardly through the housing 71, air inlet means 75b is provided for permitting introduction of hot, dry air into the dryer adjacent the lowermost dryer plate 72 so that a substantial portion of the air may then flow upwardly through the staggered openings 72a in the plates 72 in a sinuous manner, with the remaining portion flowing upwardly between the outer edges of plates 72 and circular housing wall 71a.

It is desirable to maintain the air in the dryer housing 71 at or near the highest temperature to which the sawdust may be subjected without carbonizing or burning the sawdust in the dryer 70. To this end, a duct means 75 is provided for connecting dryer 70 to a source of heated air (not shown). It will be observed in the lower portion of FIG. 1 that the discharge end of the duct means 75 enters the lower portion of the housing 71 through the side wall 71a to define the air inlet means 75 closely adjacent and above the bottom wall 71c of the housing 71. The air inlet means 75 also is disposed beneath the lowermost dryer plate 72 for introducing the hot dry air into the dryer 70 adjacent the lowermost dryer plate so that the air then may flow upwardly in the manner heretofore indicated.

Since the temperature of the hot dry air being conveyed along the duct means 75 may be so high as to carbonize or burn the sawdust being treated in the housing 71, a control valve or damper 75c is interposed in the duct means 75 downstream of and adjacent an ambient air inlet control valve means 75d (FIG. 1). The ambient air inlet valve means 75d may be opened to the desired extent to permit sufficient ambient air to enter the duct means 75 for cooling the same to the desired temperature for properly drying the sawdust in the housing 71. Additionally, the control valve 75c may be adjusted to regulate the rate of flow of the hot dry air from its source. Also, the control valve 75c may be closed, and the ambient air inlet control valve 75d may be fully opened when the operation of the dryer 70 must be interrupted and/or a substantial reduction in the temperature of the air and surfaces within the dryer housing 71 may be desired for any reason. It is apparent that, when the valve 75c is fully closed and the valve 75d is open, the hot air may bypass the dryer 70 and be exhausted from the duct means through the valve 75 to the ambient atmosphere.

It will be noted that the roof or upper wall 71b is provided with a vent 71i to permit the hot dry air being introduced into the lower portion of the dryer housing 71 to flow upwardly past and through all the plates 72 and to be exhausted from the upper portion of the housing 71.

Since it is desirable to maintain a temperature of about 350° to 400° F. within the housing 71 of the dryer 70 during normal operation of the dryer, it is preferred that the exterior surfaces of the side wall 71a, the top wall 71b, and the bottom wall 71c of the dryer housing 71, as well as the exterior surfaces of the conveyor enclosure 74b, are covered with a suitable thermal insulation material 71k. The duct means 75 also may be covered with a suitable thermal insulation material 75e.

Referring again to FIG. 1, it will be observed that the sawdust discharge outlet 71d in the bottom wall 71c of the dryer housing 71 defines the upper end of a well means 77 within which the receiving rear end portion of a filter screen 80 is positioned. Thus, the well means 77 is formed as a portion of a screen-supporting housing broadly designated at 81. The screen 80 is supported in a substantially horizontal or slightly forwardly and downwardly inclined position in the screen housing 81 and may be vibrated at the desired frequency by a suitable electric vibrator means 80a. Since vibrating screens are well known in the art, a further more detailed illustration and description of the vibrating screen 80 is deemed unnecessary.

It is to be noted, however, that the openings in the vibrating screen 80 should be of such size that only very small particles, such as sand particles, will pass through the screen 80 into the collection chamber 80b defined by the lower rear or left-hand portion of the screen housing 81 in FIG. 1. A suitable conveyor means 80c, such as an auger, may be provided for periodically emptying the sand collected in the collection chamber 80b of the housing 81.

The vibration imparted to the vibrator 80a causes the sawdust received on the rear portion of the screen 80 to advance forwardly and drop into a second well means 80d defined by a forward portion of the screen housing 81. As the dried and thus cleaned sawdust drops off the forward edge of the screen 80 and into the second well means 80d, the sawdust drops onto the rear portion of an upwardly and forwardly inclined transfer conveyor means 85 whose upper portion is arranged for conveying the dried sawdust to its site of use or to storage. The conveyor means 85 may be of any desired construction and is shown in the form of an endless chain 85a (FIG. 1) having a plurality of spaced transverse flight bars 85b thereon which pass immediately above an inclined support member 85c carried by a housing 85d within which the endless conveyor chain 85a is positioned. The conveyor means 85 may be driven by any suitable means such as an electric motor 85e (FIG. 1). The endless conveyor chain 85a may take the form of a so-called drag chain whose flight bars 85b move relatively close to or against the upper surface of the support member 85c so that the sawdust is supported on the support member 85c as the flight bars propel the sawdust upwardly to the inlet in the upper end of the hopper 90.

Experiments in the use of the ground, dried sawdust as a fuel have indicated that, desirably, the amount of moisture remaining in the same in accordance with this invention, should be no more than about 12 percent by weight. Occasionally, however, it may happen that sawdust that has passed through the housing 71 of dryer 70 has not been dried to the desired extent. To rectify such a situation, means are provided for selectively recirculatiing sawdust from the lower end of the housing 71 back to the top of the housing so that the sawdust can again pass downwardly through the dryer plates 72 for effecting further drying of the sawdust. To this end, such recirculating means includes an additional conveyor means 86 (FIG. 1) associated with the well means 80d and extending below the lowermost plate or the bottom 71c of the housing 71, which additional conveyor means 86 is adapted for receiving the dried sawdust being deposited in the well means 80d and for feeding such sawdust back onto the feed conveyor means 70*a*. It is apparent that the feed conveyor means 70*a* will then again feed the sawdust thus received thereby into the successive buckets 74*c* on the upright conveyor means 74 for delivering the same into the upper end of the housing 71 for recycling the dried sawdust through the dryer 71.

The additional conveyor means 86 is shown in FIG. 1 in the form of a screw conveyor or auger 86*a* whose lower or rear portion is positioned beneath the rear lower portion of the transfer conveyor means 85 and within the second well means 80*d* of housing 81. The additional conveyor means 86 may be driven by any suitable means such as an electric motor 86*b*, and suitable switch means, not shown, may be provided for shutting off the electric motor 85*e* whenever the electric motor 86*b* is energized, and vice versa.

The screw conveyor 86*a* is supported in a tubular member 86*c* suitably supported by the housing 71 of the dryer 70 and having an outlet member 86*d* connected to the upper end thereof for directing the sawdust conveyed by the screw conveyor 86*a* onto the upper run of the endless feed conveyor 70*a* of the dryer 70.

From the foregoing description, it can be seen that the feed conveyor means 70*a* and the upright bucket conveyor means 74 collectively constitute a first conveyor means for moving sawdust to be dried from a source to and into the top of the housing 71 of the dryer 70 and onto the uppermost dryer plate 72 therein, and the transfer conveyor means 85 serves as a second conveyor means for moving the sawdust, after drying thereof, from the lower end of the housing 71 of the dryer 70 to a site of use or to storage.

Figure 5:
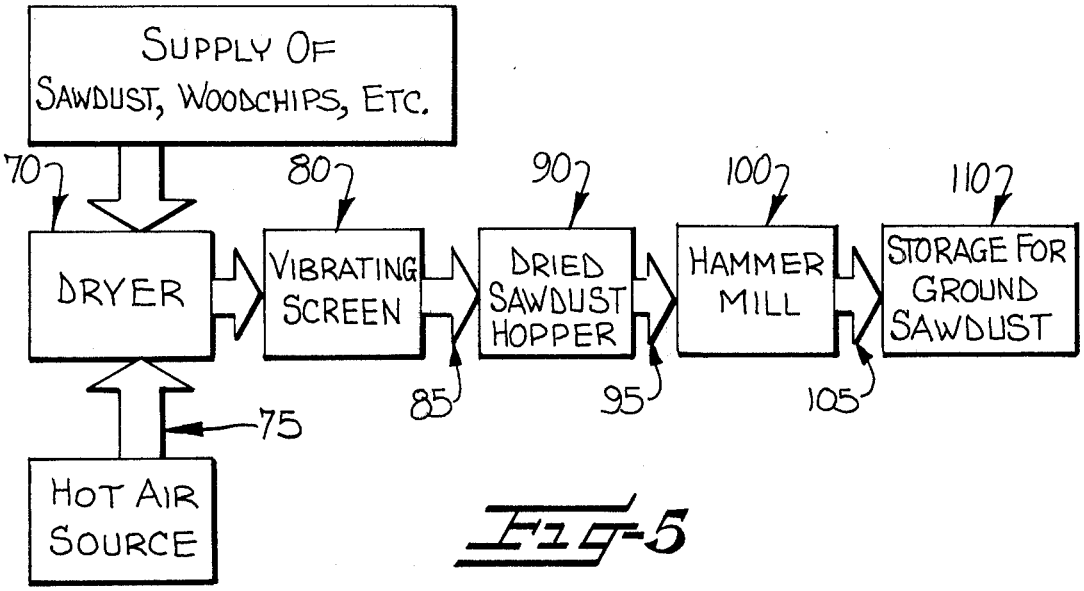
FIG. 5 is a block diagram of a system including the dryer apparatus and associated intermediate storage hopper, hammer mill and second storage bin.
Figure 6:
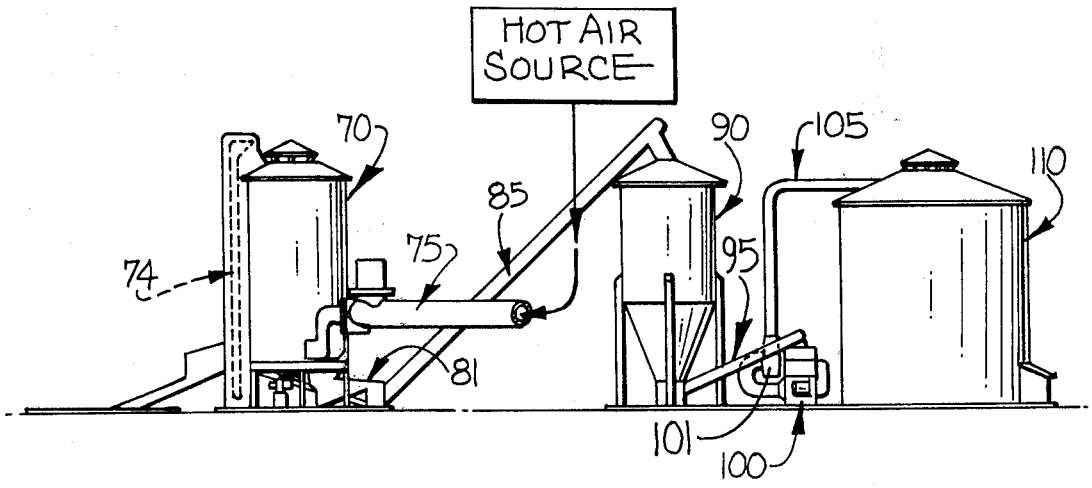
FIG. 6 is a schematic side elevation of the system diagrammed in FIG. 5.

In the particular embodiment of the invention illustrated in FIGS. 5 and 6, conveyor means 85 moves the dried sawdust from housing 71 to a first storage means embodied in a dried sawdust hopper 90. The lower portion of the sawdust hopper 90 is tapered as shown in FIG. 6 so as to aid in directing the sawdust in the hopper 90 onto the upper run of a third conveyor means 95 for feeding the dried sawdust from the first storage means or hopper 90 to the grinding means or hammer mill 100. The hammer mill 100 may be of any desired type which will grind the dried sawdust into relatively small sawdust particles and fibers of the desired size not exceeding a predetermined maximum size, for obtaining an efficient highly combustible fuel. Accordingly, a detailed description and illustration of the hammer mill 100 and its associated conveyor means 95 is deemed unnecessary. If desired, the conveyor means 95 may be of the same type as that transfer conveyor means 85 heretofore described with respect to FIG. 1.

Conventionally, the hammer mill 100 has an exhaust fan means 101 operably associated therewith for discharging the ground, dried sawdust from the hammer mill 100 and pneumatically conveying the sawdust along a conveyor means or conduit 105 into the upper end of the storage bin 110 for the ground sawdust. Other than serving for the storing of relatively large quantities of the dried sawdust, the storage bin 110 has no particular purpose insofar as the processing of the sawdust into a dry, highly combustible wood fiber fuel is concerned. Accordingly the lower portion of the storage bin 110 may include suitable conveyor means, not shown in FIG. 6, but which may be similar to the previously described conveyors, for selectively discharging sawdust from the lower portion of the storage bin 110 to a transport vehicle or to a site of use.

While the invention has been described with reference to a particular embodiment, it will be appreciated that modifications may be made without departing from the true spirit and scope of the invention.

What is claimed is:

1. A dryer apparatus for converting sawdust into a dry, highly combustible wood fiber fuel comprising an upright housing having a plurality of vertically spaced horizontal metal dryer plates therein, each of said plates having spaced-apart openings therein through which sawdust introduced at the top of the housing may successively pass downwardly to and through the plates, said openings in adjacent plates being staggered relative to each other so that the sawdust from one plate may not drop down through an opening thereof directly into an opening of the next lower plate whereby the sawdust moves downwardly in a sinuous path through the upright housing, said dryer apparatus further comprising:

upright rim means formed at peripheral portions of each of said dryer plates for preventing the sawdust from moving outwardly off of the plates, sawdust agitator means associated with the respective dryer plates and comprising rotating arms rotatable on a vertical axis and extending outwardly in overlying relation to each of the respective plates, teeth means extending from the arms and terminating in close relationship to the underlying plate and serving for agitating the sawdust for enhancement of the drying thereof, and plow means carried by the outer end portion of at least certain arms associated with at least certain plates for engagingly deflecting sawdust resting on the respective underlying plates toward the axis of the arms to overcome the outward migration imparted to the sawdust by the teeth and to further enhance the drying of the sawdust, said plow means comprising an elongate member having an outward leading end positioned inwardly of and closely adjacent said rim means and extending inwardly therefrom a predetermined distance to a trailing end, said plow means elongate member being angularly disposed with respect to said associated arm at an angle effective to deflect the sawdust inwardly, means for permitting introduction of hot dry air into the dryer adjacent the lowermost dryer plate so that at least a substantial portion of the air may then flow upwardly through said staggered openings in the plates in a sinuous manner, and well means provided below said lowermost plate and in which the dried sawdust is received.

2. A dryer according to claim 1 wherein each of the plates is stationary and is circular in shape and each has a plurality of openings in each quadrant thereof, with the openings in each quadrant being staggered relative to the openings in the corresponding quadrant of the next adjacent underlying plate, and wherein said teeth means on one arm is staggered relative to said teeth means on a next adjacent arm overlying the same dryer plate so as to impart increased agitation to the sawdust on the plate as the arms rotate thereabove.

3. A dryer according to claim 2 wherein the openings in each quadrant include a series of radially aligned openings.

4. A dryer according to claim 1 or 2 wherein conveyor means is carried by and extends upwardly exteriorly of the housing for conveying sawdust to be dried into the upper end of the housing for in turn being received by the uppermost dryer plate therein, means for selectively recirculating sawdust from the lower end of the housing back to the top of the housing so that the sawdust can again pass downwardly through the dryer plates for effecting further drying of the sawdust, and said recirculating means including an additional conveyor means associated with said well means and extending below the lowermost plate in the housing and adapted for receiving the dried sawdust and for feeding the same back to said first named conveyor means.

5. A dryer according to claim 1 or 2 including a vibrating screen located in the sawdust path between said lowermost plate and said well means, said vibrating screen having openings of such size so as to pass small undesirable particles therethrough, and the vibration imparted to said vibrating screen serving to advance the sawdust thereon to said well means.

6. A dryer according to claim 4 including a vibrating screen located in the sawdust path between said lowermost plate and said well means, said vibrating screen having openings of such size so as to pass small undesirable particles therethrough, and the vibration imparted to said vibrating screen serving to advance the sawdust thereon to said well means.

7. A dryer according to claim 1 or 2 including duct means for connecting a source of heated air to said means for permitting introduction of air, said duct means comprising an ambient air inlet valve that may be opened to permit ambient air to enter said duct means and a damper downstream of said inlet valve.

8. A dryer according to claim 4 including duct means for connecting a source of heated air to said means for permitting introduction of air, said duct means comprising an ambient air inlet valve that may be opened to permit ambient air to enter said duct means and a damper downstream of said inlet valve.

9. A dryer according to claim 5 including duct means for connecting a source of heated air to said means for permitting introduction of air, said duct means comprising an ambient air inlet valve that may be opened to permit ambient air to enter said duct means and a damper downstream of said inlet valve.

10. A dryer according to claim 6 including duct means for connecting a source of heated air to said means for permitting introduction of air, said duct means comprising an ambient air inlet valve that may be opened to permit ambient air to enter said duct means and a damper downstream of said inlet valve.

11. Apparatus for treating and converting sawdust including chunks of wood therein into a dry, highly combustible wood fiber fuel comprising a dryer, a first storage means for dried sawdust, a grinding means, and a second storage means for ground dried sawdust arranged in series, said dryer comprising an upright housing having a plurality of vertically spaced horizontal dryer plates therein, and said plates having openings therein through which sawdust introduced at the top of the housing may successively pass downwardly to and through the plates, means for introducing and directing hot dry air into the dryer adjacent the lowermost dryer plate and upwardly through the openings in the plates at a temperature and velocity so as to progressively dry the sawdust passing downwardly through the dryer without igniting the same, first conveyor means for moving sawdust to be dried, from a source, to and into the top of the housing of the dryer and onto the uppermost dryer plate therein, second conveyor means for moving the sawdust, after drying thereof, from the lower end of the housing of the dryer to said first storage means, third conveyor means for feeding the dried sawdust from said first storage means to said grinding means, said grinding means including means for reducing the fed dried sawdust to finely divided wood fibers of predetermined maximum size and for delivery thereof to said second storage means for ground dried sawdust, and fourth conveyor means for selectively recirculating sawdust from the lower end of said dryer housing to said first conveyor means for delivery back to the top of the dryer housing so that the sawdust can again pass downwardly through the dryer plates for effecting further drying of the sawdust.

12. A process for reducing the moisture content of sawdust, comprising the steps of:

conveying the sawdust to the uppermost of a plurality of vertically spaced drying zones, introducing hot dry air adjacent the lowermost zone and allowing the air to flow upwardly through the zones, successively passing the sawdust downwardly from each zone to the underlying zone by discharging the sawdust from each zone through spaced-apart discharge openings, the discharge openings of each zone being out of vertical alignment with the discharge openings of the underlying zone for allowing the sawdust to be supported at each zone for a redience time that will permit the sawdust to progressively dry as it passes down through the respective zones, agitating the sawdust with a circular raking action while it is supported at each zone in order to facilitate the drying of the sawdust and the discharge of the sawdust from the zone, and simultaneously deflecting the sawdust at the periphery of the zone inwardly toward the center of the zone in order to further enhance the drying and to overcome the outward migration imparted to the sawdust by said circular raking action, and recovering the dried sawdust below the lowermost zone.

13. A process as claimed in claim 12 including the step of selectively recirculating sawdust recovered from below the lowermost zone back to the uppermost zone so that the sawdust may again pass downwardly through the zones for effecting further drying of the sawdust.

14. A process as claimed in claim 12 including the step of grinding the dried sawdust to reduce the sawdust to finely divided wood fibers of predetermined maximum size.

15. A process as claimed in claim 12 including the step of depositing the dried sawdust on a screen having openings of such size so as to pass small undesirable particles therethrough, and vibrating the screen to advance the dried sawdust thereon to a point of recovery.

16. A process as claimed in claim 12 including the step of cooling the hot dry air introduced adjacent the lowermost zone to a desired temperature for properly cooling the sawdust by adding ambient air thereto at selected times.

* * * * *

UNITED STATES PATENT AND TRADEMARK OFFICE

CERTIFICATE OF CORRECTION

PATENT NO. : 4,371,375

DATED : February 1, 1983

INVENTOR(S) : Silas P. Dennis, Jr. and Tony M. Dennis

It is certified that error appears in the above-identified patent and that said Letters Patent are hereby corrected as shown below:

Column 3, line 22, following "the" (first occurence) insert --internal--.

Column 3, line 49, "17c" should be --71c--.

Column 5, line 5, "74a" should be --74c--.

Column 6, line 58, "recirculatiing" should be --recirculating--.

(Claim 12) Column 10, line 35 "redience" should be --residence--.

Signed and Sealed this

*Twelfth* Day of *April 1983*

[SEAL]

*Attest:*

GERALD J. MOSSINGHOFF

*Attesting Officer*

*Commissioner of Patents and Trademarks*